United States Patent [19]

Hardesty et al.

[11] Patent Number: 4,634,498

[45] Date of Patent: Jan. 6, 1987

[54] METHOD FOR THE PRODUCTION OF HIGH DENSITY FIBERBOARD

[75] Inventors: Dennis L. Hardesty, Wheeling; Timothy D. Hanna, Arlington Heights, both of Ill.; Frank J. Wendt, Kenosha, Wis.; Kendall D. White, Jr., Palatine, Ill.

[73] Assignee: United States Gypsum Company, Chicago, Ill.

[21] Appl. No.: 688,168

[22] Filed: Dec. 31, 1984

[51] Int. Cl.[4] ..... D21B 1/16

[52] U.S. Cl. ..... 162/13; 162/9; 162/25; 162/26; 162/90

[58] Field of Search ..... 162/9, 13, 10, 12, 24, 162/25, 26, 90

[56] References Cited

U.S. PATENT DOCUMENTS

| | | | |
|---|---|---|---|
| 1,881,418 | 10/1932 | Lathrop et al. | 162/13 |
| 2,454,534 | 11/1948 | Walter | 162/9 |
| 2,482,142 | 9/1949 | Chidester et al. | 162/24 |
| 3,202,568 | 8/1965 | Coggan et al. | 162/13 |
| 3,597,310 | 8/1971 | Sumi et al. | 162/25 |

*Primary Examiner*—Peter Chin

*Attorney, Agent, or Firm*—Kenneth E. Roberts; Robert H. Robinson; Robert M. Didrick

[57] ABSTRACT

High strength and high density wood fiberboard is formed by treating the wood fiber source material with a highly alkaline solution, such as sodium hydroxide solution, before interfelting the fibers into a loose mat. The wood source material may be treated after refining the material into fibers, but preferably, the wood source material is treated before fibrillation. Further, wood fiber source material may be partially neutralized before felting without substantial change in the resulting densities and strengths.

8 Claims, 2 Drawing Figures

METHOD FOR THE PRODUCTION OF HIGH DENSITY FIBERBOARD

BACKGROUND OF THE INVENTION

1. Field of the Invention

The present invention relates to fiberboard and a method of densifying the same. More particularly, it is concerned with production of high density, high strength, cellulosic fiberboard, such as one produced from wood fiber.

2. Description of the Prior Art

Structural insulating fiberboard is defind in ASTM D-1554 as a homogeneous panel made from lignocellulosic fibers characterized by an internal bond produced by interfelting of the fibers, and consolidated as a separate stage in manufacture, to a density of more than 10 pounds per cubic foot (pcf) and less than 31 pcf. There is a marked trend in the fiberboard industry to manufacture general purpose insulating fiberboards in specific density ranges for particular uses. However, it is difficult to manufacture specific boards in the higher portion of the density range. Large amounts of heavy fillers must be added, but then, augmenting binders must be added to recapture loss of strength caused by the fillers.

U.S. Pat. No. 2,639,989 discloses the addition of a hydrated lime slurry, of about 10% undissolved lime solids, as filler to the hot fiber pulp being fed to the head box for interfelting to produce a dried board containing approximately 6% lime solids, providing a density increase to 25–28 pcf, compared to an untreated board density of 16–17 pcf. Besides adding weight, this amount of undissolved lime solids in the resulting fiberboard could cause localized skin and eye irritation in handling, particularly if the board becomes wet.

SUMMARY OF THE INVENTION

In brief, this invention is concerned with making high density, high strength fiberboard without the addition of heavy fillers and separate binders, and without the necessity of high pressure platen pressing.

It is an object and advantage of the present invention to provide fiberboard of increased density and strength without the necessity of adding large amounts of undissolved lime precipitate fillers or other strength additive materials such as starch binders.

A further object is the provision of means to increase the density and strength of structural fiberboard through treatment of the fiber with a high pH solution and without the necessity of retained fillers and without the precautions required to handle a high precipitated lime content board.

It has how been found that very dramatic increases in density, strength and other properties of the resultant fiberboard may be accomplished by treating the fiber with a highly alkaline solution without the necessity of undissolved lime filler addition or binder adjuvant. Further, it has been found that treating the fiber with the highly alkaline solution during refining to form an aqueous slurry of the fiber and refining the fibers at a temperature below the boiling point of the aqueous slurry results in an essentially irreversibly modified fiber, and the fiber dispersion may be partially neutralized before felting so that no particular handling precautions or equipment changes are required in subsequent processing operations. Both approaches allow the use of higher forming consistencies. Thus, the above objects and advantages and others are accomplished by treating the cellulose fiber source material, preferably before mat formation, with a highly alkaline solution sufficient to produce a fiber suspension having a pH from about 12 to 14. The fiber source material is treated with a strong hydroxide solution, preferably during refining, dewatered and redispersed at lower solids consistency. If desired, it can be treated with an acidic solution to neutralize the slurry before felting to form an increased density, increased strength fiberboard. Thereby, in the preferred manner fiberboard is formed without specialized equipment or handling procedures.

DETAILED DESCRIPTION OF THE PREFERRED EMBODIMENTS

Figures 1, 2:
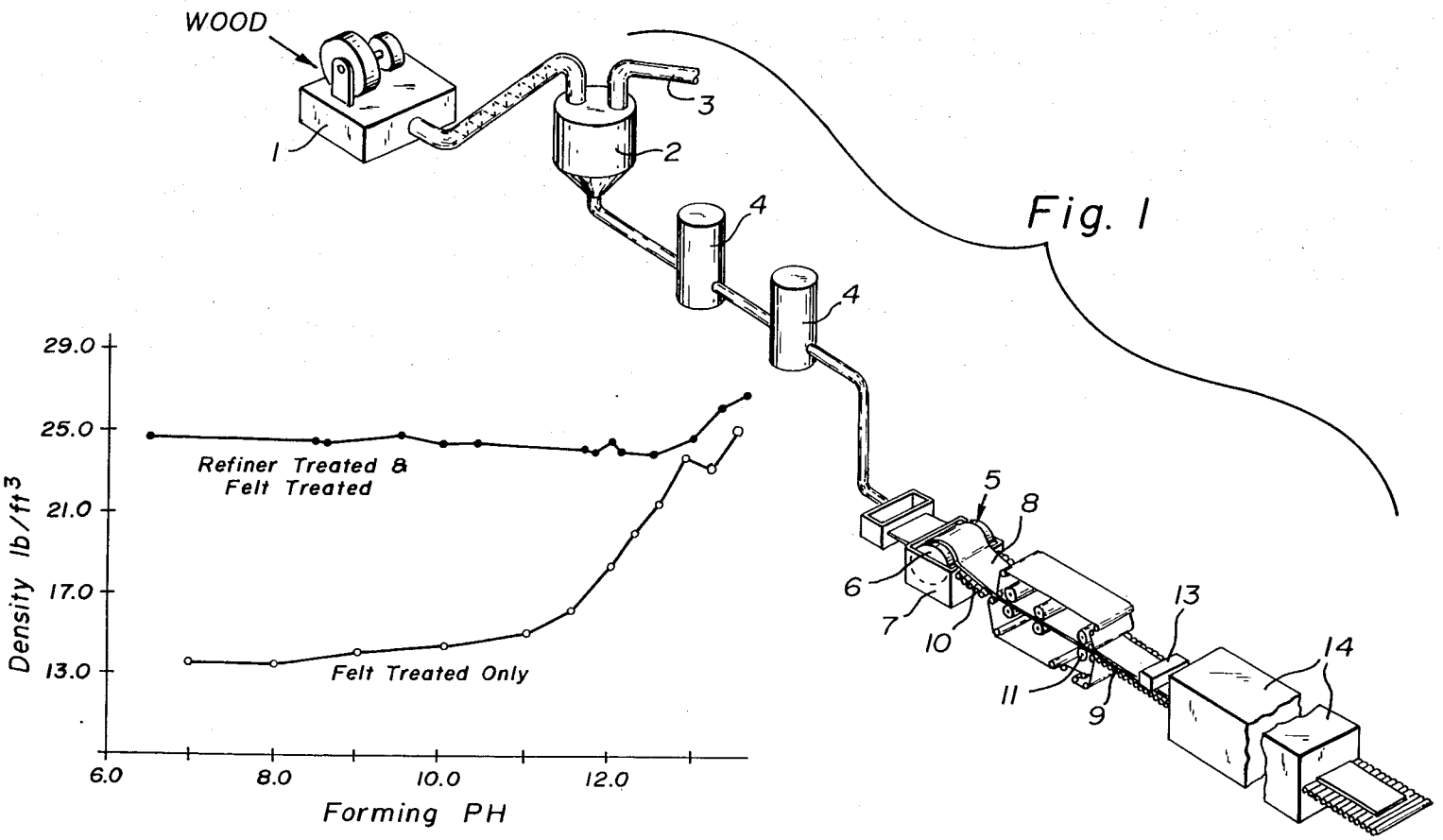
FIG. 1 is a schematic representation of the preferred process for the practice of the present invention.
FIG. 2 is a graphic representation of density changes versus felting at various pH levels.

In brief, the invention comprises treating a wood fiber source material, generally wood, with an alkaline solution to provide an aqueous slurry of about 12–14 pH, and then interfelting the treated fibers to form a fiberboard product of high density and strength. The alkaline solution may be applied to the fiber source material before, during, or after refining of the source material, or it may be applied to the formed fiber at any point up to the interfelting of the fibers to form a fiberboard product.

Referring to FIG. 1, the process shown therein schematically depicts a continuous process for wet fiberizing and wet felting production or rigid insulation board from a dilute aqueous slurry containing primarily fibers and water. The fibers for use herein are usually obtained from wood; however, other cellulosic fiber sources may be used depending upon the supply of available materials. For example, corn stalks, sugar cane, waste paper fibers or the like may be utilized alone or in combination with wood fibers. Non-coniferous wood sources such as aspen wood is preferred to avoid foaming and resin interference with the effect of alkaline solution treatment. The wood or other cellulosic fiber source material, preferably in the form of chips obtained in wood chipper 1, is fed to one or more mechanical refiners 2 and fibrillated therein. Thus, in one preferred specific embodiment, wood chips fed from chipper 1 are mixed with a sodium hydroxide solution of about pH 11–13.8 or higher, at about 110° F.–150° F. to yield a suspension of about 5–20% solids, then mechanically worked in a Bauer or other conventional refiner 2 to mechanically defiber the wood to fibers. The sodium hydroxide is introduced through a conventional shower water line 3. The particular refiner illustrated is of the Bauer type in which a low consistency solids slurry of wood chips and water is passed through rotating grinding plates (not shown) within refiner 2 to defibrillate the fiber source material into individual fibers and bundles of fibers. Ordinarily the defibrillated material would present an appearance of long, slender, and usually ribbon-like smooth wood pulp fibers. With the highly alkaline solution treatment, the fibers appear to have a more rough and ragged surface. According to the invention in its preferred form, the alkaline solution is introduced with water of dilution in shower line 3.

From the refiner 2, the slurry passes through a dewatering device, such as a Decker (not shown) and then optionally rediluted and stored in stirred holding tanks 4 where the stock may be further worked mechanically. The dewatering step provides the opportunity to drain off some of the highly alkaline solution and replace it with fresh or acidified water to produce a suspension of about 1%–5% consistency and having a pH of about 11–6 for feeding to the mat forming machine. The particular mat forming machine 5 illustrated is of the Oliver type: however, a continuous forming machine of the Fourdrinier type, or other such machine for felting fibers into a mat may be substituted therefor. In the Oliver machine illustrated, a continuously rotating cylinder 6 has on its outer periphery a foraminous surface connected to a vacuum source. The foraminous surface is rotated within a vat 7 having the slurry maintained at a predetermined level, and the slurry is continuously fed as mat is formed and withdrawn so as to maintain the solids consistency in the vat. The fibers, and any other solids which may be used within the slurry, are picked up by, or deposited upon, the foraminous surface of the cylinder 6 thereby forming a loose, wet mat 8 of predetermined thickness. The periphery of the mat, in effect acts as a filter, with the solids being deposited on the periphery while the water is passed centrally thereof and usually recirculated. When sufficient water has been removed therefrom, the formed wet mat 8 is removed from the cylinder, and deposited via transfer sheet 9 onto rollers 10. The rollers transfer the continuously formed mat to the remaining steps of fiberboard manufacture, while continuously draining the water therefrom. Thus, the formed mat is passed between opposed compressing rolls 11 which assist in expressing additional water from the mat. The mat is passed to a drier 13 as illustrated and if desired, it may be passed through an optional coating or spray apparatus 14 to impart any further desired sealant or coating onto the fiberboard product.

In one less preferred embodiment, the wood chips may be soaked in a saturated, highly alkaline solution, optionally drained of excess solution, and then defibrillated in an air or water suspension.

The highly alkaline solution for use in the present invention may be any strongly basic aqueous solution. For reasons of convenience and availability, commercial 50% sodium hydroxide solutions may be diluted with water and introduced at any convenient dilution point in the conventional pulp production for interfelting. The highly alkaline solution may also be of any other soluble alkali metal compound such as compounds of potassium, sodium, lithium, rubidium, cesium, francium, and mixtures thereof that give the appropriate pH solution. The highly alkaline solution may also be formed of aqueous solutions of alkaline earth metal compounds of beryllium, magnesium, calcium, strontium, barium, radium and mixtures thereof or mixtures with alkali metal solutions, or mixtures with other highly alkaline basic solutions.

While we do not wish to be bound by any particular theory of operation, it is currently believed that exposing the wood structure, during the intense mechanical working of the wood fiber source material undergoing refining to fibers, to the strongly basic solutions changes the zeta potential of the wood and appears to further unravel the microfibrille bundles of the fibers in an irreversible fashion. Ordinarily, wood fiber in general is a smooth-surfaced, long ribbon-like fiber that has a zeta potential in the range of 3–18 millivolts. By treatment according to the present invention, there is an over tenfold increase in zeta potential and the fibers appear much more ragged and rough along their surface. By this process, aspen fiber changes to show a Zeta meter reading of a zeta potential of 30–70 on neutralized pulps, and without neutralization of readings to over 200 millivolts, beyond the accuracy limits of the testing apparatus. During interfelting of the treated fibers, the fibers appear to stay apart from each other longer than normal, thus allowing faster and greater expression of the fiber carrier medium. The treated fibers appear to have a different orientation during felting which appears to result in better packing in terms of densification and strength development subsequent to interfelting. The more unraveled microfibrille bundles of fibers on the surfaces of the fiber further appear to be physically interacting during interfelting with increasing surface area entanglement. This would explain the more compact densification and greater bonding strength of the resultant board.

In accordance with the present invention, the highly alkaline solution treated wood fiber source material may be processed into finished wood fiberboard having thicknesses ranging from about ⅛th inch through about 2 inches of varying densities and strengths, depending upon the degree of treatment. Densities on the order of 18 pounds per cubic foot through about 28 pounds per cubic foot and more may be obtained. Strengths, measured as modulus of rupture (MOR) in pounds per square inch from about 200 psi through about 1200 psi and more may be obtained, as will be illustrated in the following specific examples. For comparison, ordinary board prepared in the laboratory prior to the following examples averaged about 14 lb/ft density and 150 psi MOR with a corrected TAPPI standard drainage time to dewater the loose mat of about 15 seconds.

EXAMPLES

A series of evaluations were conducted on laboratory-sized mixing, felting and pressing equipment. For these evaluations an aspen refined wood fiber was obtained and treated. In some of the evaluations small sample boards were obtained by felting the treated fiber aqueous suspensions through a laboratory TAPPI drainage tester tube to obtain a small wet "pad" which was then wet pressed using a standard press cycle of increasing pressure increments to 150 pounds force per square inch (lbf) and oven dried at 250° F. to constant weight. In other of the evaluations, larger samples were obtained on a laboratory mini-line that formed 17 inch by 17 inch wet mats, with wet pressing and drying conditions remaining the same as for the smaller samples.

EXAMPLE 1

A detailed study was made of the effect of forming pH on board density, modulus of rupture, and corrected drainage time (CDT) properties of aspen wood fiber. To accomplish this, aspen fiber from the Bauer refiner in a commercial wood fiberboard plant was collected. A number of mats were formed on the laboratory mini-line at various pH levels ranging from about neutral to about 13.5. The pH levels of the slurry being fed to the forming operation were adjusted with either sodium hydroxide or sulfuric acid. Once formed, ⅜th inch thick mats were oven dried at 250° F., trimmed to a 17 inch by 17 inch size, and physical properties determined according to ASTM procedures. Results, as set forth in FIG. 2 as "Felting Treated Only" and in Table 1, generally show that there was little gradual change in density as interfelting pH increased from neutral toward about pH 12. However, from about pH 12 and higher there was a dramatic influence on density. Strength values, not shown graphically, followed the same general pattern, with MOR increasing over 150% on going from pH 11 to pH 12 and over 115% from pH 12 to pH 13.

In further evaluations, aspen fiber was treated during refining with sodium hydroxide solutions to obtain a slurry in the Bauer refiner of pH 13.3, and the refiner treated fiber was then formed into mats at various forming pH levels as set forth earlier in this example. The results, set forth in FIG. 2 as "Refiner Treated and Felting Treated" and in Table 2 very dramatically illustrate that highly alkaline solution treatment during fibrillation results in a fiber effect that is virtually not affected by subsequent changes in forming pH. The density data as shown in FIG. 2 presents an almost straight line without regard to forming pH between neutral and about pH 12. Thus the fiber may be treated during refining at high pH and then neutralized for interfelting without substantial loss of the very high densities. The density data in Table 2 shows a mean value of 24.65 lbs/ft.$^3$ with a standard deviation of only 0.87 lb./ft.$^3$ over the range of 6.5–13.6 pH. This is only a 4 percent change in values. The MOR data, not shown graphically, presents roughly the same trend, with a mean value of 916 psi and a standard deviation of 87 psi for all forming pH levels evaluated. Although there was more scatter of individual values, there is less than a 10% change over the whole range evaluated. The corrected drainage times (CDT) show that acceptable forming machine speeds may be maintained over the full range of pH values.

In further evaluations, aspen fiber treated during refining with sodium hydroxide solutions of pH 12.2 and 13.3 at various temperatures between about 60° F.–160° F. were formd into felted pads and evaluated. There was an increase in board density with increasing temperatures at pH 13.3, but less appreciable increase at pH 12.2. The effects were higher for a 20 second corrected drainage time than for a 40 second corrected time.

In additional evaluations, aspen fiber slurries varying in consistency from 1% to 5% and then raised in pH to 13.6 pH were formed into small pads. Density increased directly as fiber forming consistency was increased.

TABLE 1

| Mat Forming pH | Felting Treated Density (lb./ft$^3$) | MOR (psi) | CDT (seconds) |
|---|---|---|---|
| 7.0 | 13.6 | 141 | 14.5 |
| 8.0 | 13.5 | 123 | 15.4 |
| 9.0 | 14.1 | 130 | 15.7 |
| 10.05 | 14.4 | 169 | 16.9 |
| 11.0 | 15.1 | 147 | 18.0 |
| 11.55 | 16.2 | 228 | 27.9 |
| 12.0 | 18.5 | 373 | 51.1 |
| 12.3 | 20.1 | 542 | 53.4 |
| 12.6 | 21.6 | 779 | 84.3 |
| 12.9 | 23.8 | 807 | 110.1 |
| 13.2 | 25.2 | 813 | 80.7 |
| 13.5 | 23.4 | 865 | 83.4 |

TABLE 2

| Mat Forming pH | Refined at 13.3 then Felting Treated Density (lb./ft$^3$) | MOR (psi) | CDT (seconds) |
|---|---|---|---|
| 13.6 | 26.8 | 912 | 104.9 |
| 13.3 | 26.2 | 1060 | 118.2 |
| 13.0 | 24.7 | 1115 | 131.3 |
| 12.5 | 23.9 | 807 | 82.8 |
| 12.1 | 24.0 | 910 | 94.2 |
| 11.7 | 24.0 | 891 | 63.6 |
| 11.0 | 24.4 | 916 | 52.3 |
| 10.8 | 24.0 | 857 | 48.7 |
| 10.4 | 24.4 | 835 | 49.3 |
| 10.0 | 24.3 | 896 | 54.0 |
| 9.5 | 24.7 | 920 | 47.4 |
| 8.6 | 24.4 | 886 | 50.2 |
| 8.5 | 24.5 | 807 | 48.7 |
| 6.5 | 24.6 | 935 | 43.4 |

When these same conditions were re-examined with the exception of now diluting each slurry to 1% consistency prior to mat formation, higher mat densities were obtained with the slurries that had higher consistencies prior to dilution.

EXAMPLE 2

A trial was conducted on full size production equipment. For this trial a 50% sodium hydroxide solution was pumped into the refiner shower water feed line so as to obtain a pH level of 13.6 in the refiner during its operation. Wood chips and water were fed to the refiner and the stock refined at about 150° F., then passed to holding tanks for about five minutes to age the stock and obtain thorough dispersion of the fibers in the carrier water. The pH in the holding tanks was monitored as being about 12 during the trial and was briefly reduced in the headbox to pH 11 during the trial with concentrated sulfuric acid addition to the headbox. Oliver vat consistencies were maintained between 2.2% and 2.5% solids and the refined stock was felted at a machine speed of 15 feet per minute on the Oliver mat forming machine. During the first half of the trial the wet mat caliper was maintained at approximately 31/64th of an inch to obtain a ⅜th inch finished board. Obtained board density was 25.8 pcf modulus of rupture was 676 psi, tensile strength was 424 psi, and Janka ball hardness was approximately 205 pound load. In comparison, conventional ⅜th inch insulation board from this same line has a density of 14.5 pcf modulus of rupture of 375 psi, tensile of 200 psi and Janka ball hardness value of 75 pound load.

What is claimed is:

1. A process for making wood fiberboard of the type in which:

(1) a wood fiber source material is fibrillated into fibers, (2) the fibers are interfelted into a loose mat, (3) the mat is lightly roll compressed, (4) and the mat is dried and finished to form a fiberboard product of at least about ⅛th inch thickness, characterized by the improvement of the steps: consisting essentially of:

mechanically fibrillating raw wood chips with essentially simultaneous addition of a highly alkaline aqueous solution sufficient to form an aqueous slurry having a pH of at least about pH 12, fibrillating said wood chips at a temperature below the boiling point of said aqueous slurry and imparting an about at least three-fold increase in the zeta potential of fibers from the fiber source material, whereby densities greater than about 20 pounds per cubic foot and strengths greater than 500 psi modulus of rupture are obtained.

2. The process of claim 1 including the further steps of neutralizing the highly alkaline slurry to a pH between about pH 6 and pH 11, and thereafter interfelting the neutralized slurry into a loose mat.

3. The process of claim 1 in which a dilute aqueous slurry of wood chips, and water is fed into a mechanical defibrillator and, during intense mechanical working of the wood chips to fibers, the wood is exposed to sufficient sodium hydroxide as to form a pH 12–14 wood fiber slurry; the wood fiber slurry is partially neutralized to a pH of about pH 9–11; and the neutralized slurry is interfelted into a loose mat of fibers.

4. A process for making a high density, high strength wood fiberboard, having a density greater than about 24 pounds per cubic foot and a modulus of rupture greater than about 800 psi comprising the steps of:

(a) forming an aqueous slurry of wood chips and water and feeding the slurry to a mechanical refiner;

(b) feeding a highly alkaline aqueous solution to the refiner and refining the solution and wood chips slurry at a temperature below the boiling point of said aqueous slurry containing said alkaline solution to refine the chips into a fiber slurry haviing a pH of about 13–14;

(c) neutralizing the fiber slurry to a pH of about 9–11;

(d) interfelting the fiber slurry into a loose fiber mat; and (e) expressing water from the mat and drying the mat to form a finished fiberboard.

5. The process of claim 4 in which said alkaline solution is sodium hydroxide.

6. The process of claim 4 in which said neutralizing is with sulfuric acid.

7. The process of claim 4 in which said slurry of wood chips, water, and alkaline solution has a pH of about 13.

8. The process of claim 4 in which said fiber slurry is neutralized to about pH 9.

* * * * *